US010121642B2

(12) United States Patent
Mane et al.

(10) Patent No.: US 10,121,642 B2
(45) Date of Patent: Nov. 6, 2018

(54) DIGITAL ELECTRON AMPLIFIER WITH ANODE READOUT DEVICES AND METHODS OF FABRICATION

(71) Applicant: UChicago Argonne, LLC, Chicago, IL (US)

(72) Inventors: Anil U. Mane, Naperville, IL (US); Jeffrey W. Elam, Elmhurst, IL (US)

(73) Assignee: UChicago Argonne, LLC, Chicago, IL (US)

( * ) Notice: Subject to any disclaimer, the term of this patent is extended or adjusted under 35 U.S.C. 154(b) by 0 days.

(21) Appl. No.: 15/952,973

(22) Filed: Apr. 13, 2018

(65) Prior Publication Data

US 2018/0233339 A1 Aug. 16, 2018

Related U.S. Application Data

(62) Division of application No. 14/694,935, filed on Apr. 23, 2015.

(51) Int. Cl.
*H01J 43/24* (2006.01)

(52) U.S. Cl.
CPC ..... *H01J 43/246* (2013.01)

(58) Field of Classification Search
CPC ..... H01J 43/12; H01J 43/28; H01J 43/246
See application file for complete search history.

(56) References Cited

U.S. PATENT DOCUMENTS

| | | | |
|---|---|---|---|
| 5,306,904 | A | 4/1994 | Shimabukuro et al. |
| 5,568,013 | A | 10/1996 | Then et al. |
| 6,384,519 | B1 | 5/2002 | Beetz et al. |
| 7,049,747 | B1 | 5/2006 | Goodberlet et al. |
| 7,294,954 | B2 | 11/2007 | Syms |
| 8,604,440 | B2 | 12/2013 | Frisch et al. |
| 8,729,447 | B2 | 5/2014 | Jarron et al. |
| 8,921,799 | B2 | 12/2014 | Elam et al. |
| 8,969,823 | B2 | 3/2015 | Elam et al. |
| 2007/0007462 | A1 | 1/2007 | Stevens et al. |
| 2012/0187305 | A1 | 7/2012 | Elam et al. |
| 2013/0280546 | A1 | 10/2013 | Elam et al. |

FOREIGN PATENT DOCUMENTS

| | | |
|---|---|---|
| EP | 2 278 609 A1 | 1/2011 |

*Primary Examiner* — Kevin Quarterman
(74) *Attorney, Agent, or Firm* — Foley & Lardner LLP

(57) ABSTRACT

Scalable electron amplifier devices and methods of fabricating the devices an atomic layer deposition ("ALD") fabrication process are described. The ALD fabrication process allows for large area (e.g., eight inches by eight inches) electron amplifier devices to be produced at reduced costs compared to current fabrication processes. The ALD fabrication process allows for nanostructure functional coatings, to impart a desired electrical conductivity and electron emissivity onto low cost borosilicate glass micro-capillary arrays to form the electron amplifier devices.

14 Claims, 7 Drawing Sheets

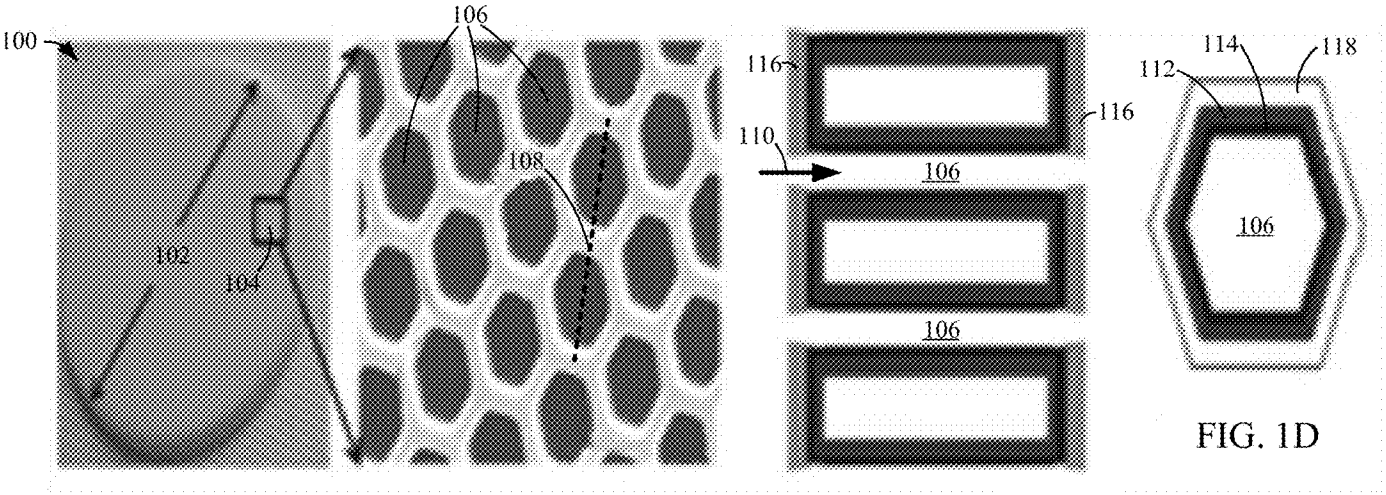
FIG. 1A
FIG. 1B
FIG. 1C
FIG. 1D
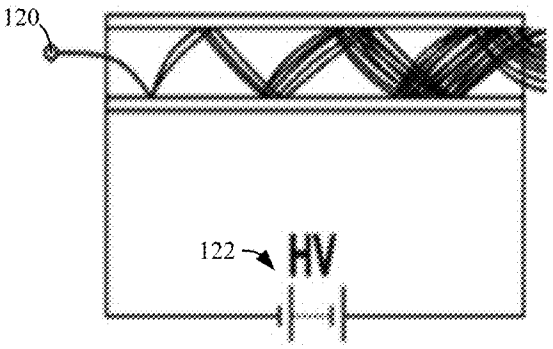
FIG. 1E

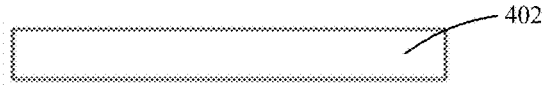
FIG. 4A
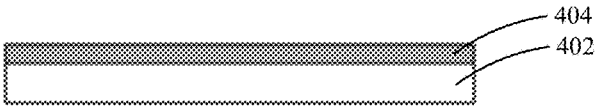
FIG. 4B
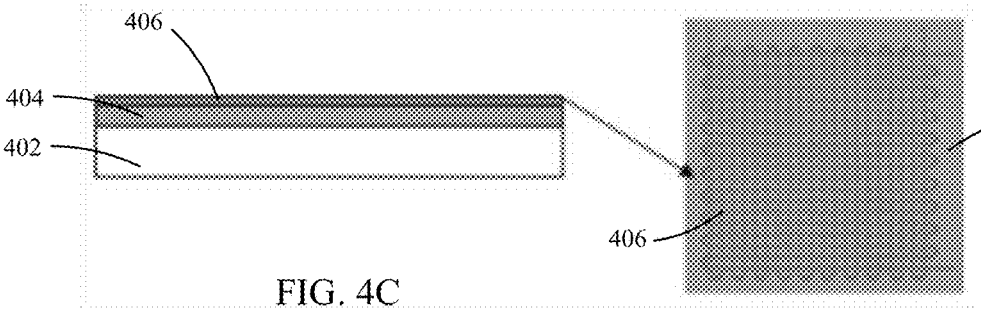
FIG. 4C
FIG. 4D
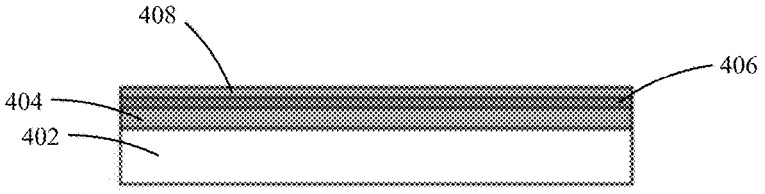
FIG. 4E

DIGITAL ELECTRON AMPLIFIER WITH ANODE READOUT DEVICES AND METHODS OF FABRICATION

CROSS-REFERENCE TO RELATED APPLICATIONS

This application is a divisional of U.S. patent application Ser. No. 14/694,935, filed on Apr. 23, 2015, the content of which is fully incorporated by reference herein in its entirety.

STATEMENT OF GOVERNMENT INTEREST

The U.S. Government has rights in this invention pursuant to Contract No. DE-AC-02-06CH11357 between the U.S. Government and the UChicago Argonne, LLC representing Argonne National Laboratory.

FIELD

The present disclosure relates generally to electron multiplier devices and methods of producing electron multiplier devices.

BACKGROUND

Electron multiplier devices are used in many applications to multiply incidental charges through secondary emission. Electron multiplier devices can take a single electron, and via secondary emission, can induce emission of more electrons from an emissive material. This process can be repeated to multiply a single detected electron (e.g., an electron passing through the electron multiplier device) into a larger number of electrons that are directed towards a metal anode for detection. Certain electron multiplier devices, such as channel electron multipliers and channeltrons ("CEM"), offer a high dynamic range of electron multiplication to assure an absolutely linear response, which results in electron multiplier devices having capabilities beyond the limits of most analytical instruments. Due to their low mass and high gain, electron multipliers are used in many nuclear physics labs and space applications to count electrons and charged particles (e.g., in a pulse mode of operation). Electron multipliers may be used in mass spectrometry applications, residual gas analyzers, plasma analysis applications, Auger electron spectroscopy applications, electron spectrometers, secondary electron multiplier devices, focused ion beam emitters, and leak detectors.

In general, CEMs are made out of single tube and can be referred to as one dimensional devices. In contrast to CEMs, another geometry of continuous-dynode electron multiplier is called the microchannel plate ("MCP"), which is two-dimensional arrays of microscopic channel electron multipliers. MCP photo-multipliers ("MCP-PMT") are an evolution from the basic principles of photo-multipliers. MCP-PMTs utilize planes of small pores, which form the amplification sections of the complete MCP-PMT devices. Current MCP-based detectors have shown unique properties such as high gain, high spatial resolution, high timing resolution, and very low background rate. These properties make MCP detectors useful in a wide variety of applications including low-level signal detection, photodetection, gas electron multipliers ("GEM"), time-of-flight ("ToF"), mass spectrometry, molecular and atomic collision studies, electron microscopy, field emission displays, night vision goggles and binoculars, and high speed and resolution cameras. At present, small area conventionally made MCPs are extensively used in photo-detection for visible light night vision applications and used in photodetectors for high energy physics and nuclear physics.

Conventional MCPs are fabricated using multi-fiber glass working techniques to draw, assemble, and etch an array of solid core fibers resulting in channels in a thin wafer of lead silicate glass. Although pore diameters as small as six microns have been achieved, these channels are typically ten to forty microns in diameter, have an aspect ratio ($\alpha$=(L/D) =pore length/pore diameter) of sixty to one hundred, and have an open area ratio (i.e., fraction of surface covered by pores) of fifty to seventy-five percent. Thermochemical processing (e.g., $H_2$ firing) is used to activate the channel walls for electron multiplication, and metal electrodes are evaporated onto both faces to provide electrical contact. More recently, techniques have been developed for creating capillary glass arrays and subsequently coating the arrays with thin, conformal films that provide electrical conductivity and secondary electron emission properties. Exemplary MCPs manufactured using capillary glass arrays are described in U.S. Pat. No. 8,969,823, entitled "MICROCHANNEL PLATE DETECTOR AND METHODS FOR THEIR FABRICATION," dated Mar. 3, 2015, which is herein incorporated by reference in its entirety and for all purposes.

However, current MCPs are limited in performance and are expensive to manufacture. The etching required for solid core, lead glass MCPs add to the manufacturing costs and limits the electron gain of the given MCP. Moreover, the hydrogen firing dictates both the MCP resistance and the secondary emission, and so these properties cannot be independently varied. Finally the lead glass utilized is brittle and hygroscopic, which causes MCPs to be prone to breakage during handling. The capillary glass method overcomes some of these limitations; however, fabricating the capillary glass arrays is very labor intensive. For example, the capillary glass method requires manual alignment of thousands of hollow glass tubes, which translates to high manufacturing costs.

SUMMARY

One embodiment relates to a digital electron amplifier system. The system includes a base substrate having a top surface, an anode structure, and an electron amplification structure ("EAS"). The EAS includes an insulating oxide layer, a bottom electrode, a top electrode, a resistive layer positioned between the top electrode and the bottom electrode, and a plurality of pores traveling through the insulating oxide layer, the bottom electrode, the resistive layer, and the top electrode. The walls of the plurality of pores are coated with a secondary electron emission coating. The anode structure is exposed at a bottom of each of the pores.

Another embodiment relates to a method of fabricating a digital electron amplifier system on chip. The method includes providing a base substrate having a top surface. The method further includes depositing an insulating layer on the top surface of the base substrate. The method includes providing an anode structure on top of the insulating layer and depositing an insulating oxide layer on top of the anode structure. The method includes forming an electron amplification structure ("EAS") on top of the insulating oxide layer. The EAS has a bottom electrical contact, a top electrical contact, and a resistive layer positioned in between the bottom electrical contact and the top electrical contact. The method includes forming electron amplification pores.

Each of the electron amplification pores passing through the top electrical contact, the resistive layer, the bottom electrical contact, and the insulating oxide layer thereby exposing the anode structure at a bottom of each of the electron amplification pores.

These and other advantages and features of the invention, together with the organization and manner of operation thereof, will become apparent from the following detailed description when taken in conjunction with the accompanying drawings.

BRIEF DESCRIPTION OF THE FIGURES

FIGS. 1A through 1E show an MCP formed via an atomic layer deposition fabrication process according to an exemplary embodiment.

DETAILED DESCRIPTION

Figure 2:
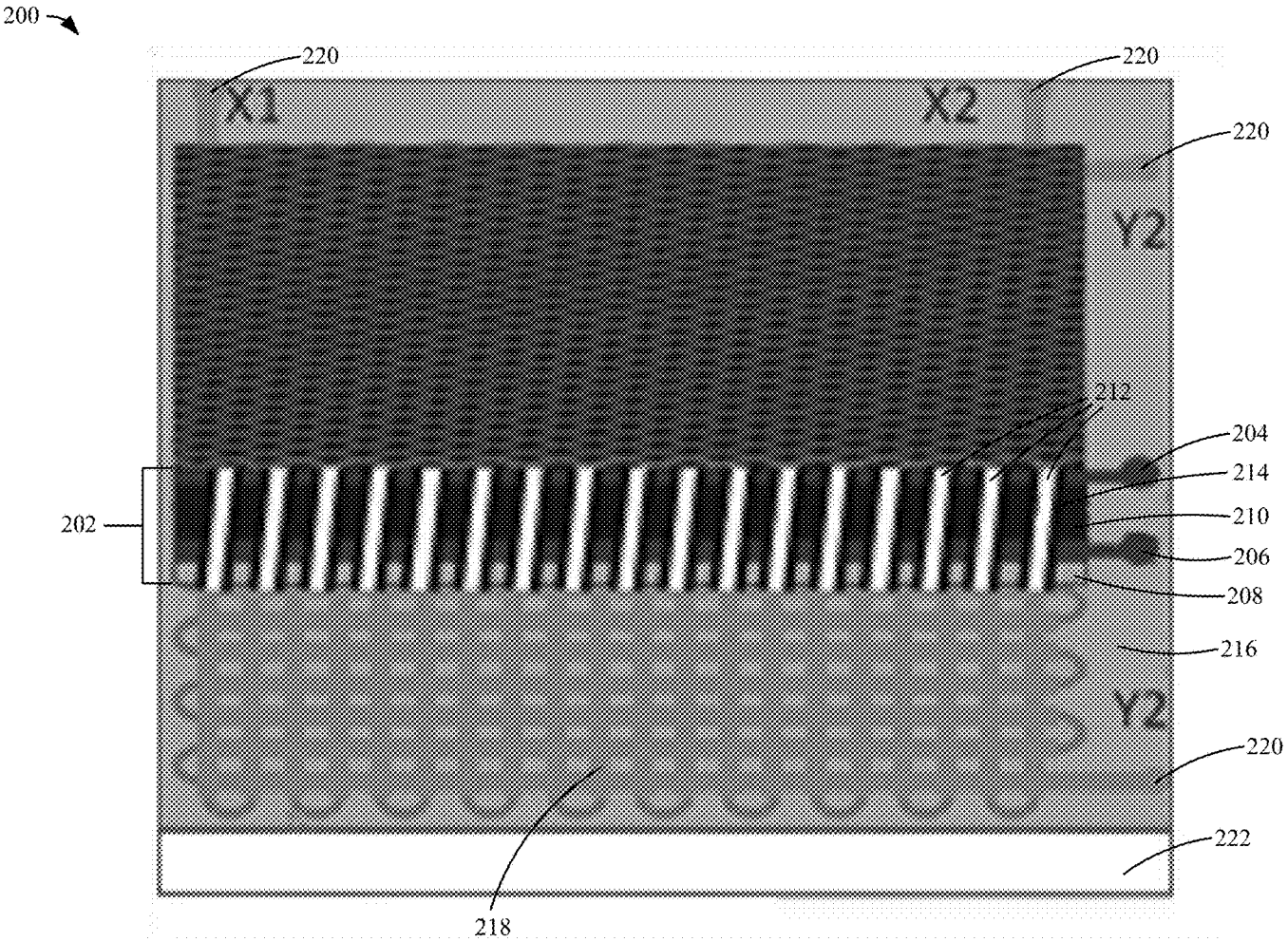
FIG. 2 is a schematic cross-sectional view of a system on chip ("SoC") type digital electron amplifier according to an exemplary embodiment.

Referring to the figures generally, scalable MCPs and methods of producing the scalable MCPs through an atomic layer deposition ("ALD") fabrication process are described. The ALD fabrication process allows for large area MCPs (e.g., approximately eight inches by eight inches) to be produced significantly less expensive than prior MCP fabrication processes. The ALD fabrication process allows for nanostructured functional coatings, to impart a desired electrical conductivity and electron emissivity onto low cost borosilicate glass micro-capillary arrays ("MCA") to form the scalable MCPs. The ALD functionalized MCPs have a combination of unique properties, such as high gain (e.g., $>10^7$), high spatial resolution (e.g., one millimeter), high timing resolution (e.g., <10 ps), very low background rates (e.g., <0.06 events $cm^{-2}$ $sec^{-1}$) and long lifetimes (e.g., >7 $C/cm^2$). The unique properties of the MCPs formed via the ALD fabrication process make ALD functionalized large area MCPs useful in a wide variety of applications (e.g., low-level signal detection, photodetection, GEMs, ToF analyzers, mass spectrometry, molecular and atomic collision studies, electron microscopy, field emission displays, night vision goggles and binoculars, high speed and resolution cameras, etc.). By applying a conformal neutron sensitive layer to the MCP, the MCP can be used for neutron detection, which has applications in the detection of nuclear sensitive materials.

Referring to FIG. 1A, a perspective view of an MCP 100 formed via an ALD fabrication process is shown according to an exemplary embodiment. The MCP 100 is formed with the ALD fabrication process described below with respect to method 300. In some arrangements, the MCP 100 is circular in shape and has a diameter 102. The diameter 102 may be approximately thirty-three millimeters. Although shown as being circular in shape, the MCP 100 may have other shapes (e.g., rectangular, square, triangular, trapezoidal, etc.). FIG. 1B shows a magnified view of the MCP 100 at area 104. As shown in FIG. 1B, a plurality of pores 106 pass through the MCP 100. The pores 106 may be of a circular shape, hexagon shape, or another polygon shape. The pores 106 may be perpendicularly aligned to the MCP surface, aligned at a constant bias angle, or aligned such that the bias angle changes as a function of distance along the length of the pores 106. The pores 106 may form a honeycomb structure for the MCP 100. In some arrangements, the pores 106 have a diameter of approximately twenty micrometers. The pores 106 are ALD nanostructure functionalized MCP pores. FIG. 1C shows a cross-sectional diagram of the composition of the MCP 100 taken along line 108. FIG. 1D shows a cross-sectional diagram of the composition of a pore 106 from the perspective of arrow 110. The pores 106 include a resistive coating 112 and an emissive coating 114. Each pore 106 traverses between a nickel chromium contact electrode 116. The base 118 of the MCP 100 may be formed from an MCA formed from a low cost borosilicate glass.

Referring to FIG. 1E, a schematic view of an electron multiplication effect through a pore 106 is shown. To create an electron amplification or multiplication, a uniform electric field is generated along the pores 106 of the MCP 100 by applying a negative bias potential between the input and output electrodes (i.e., between the electrodes 116) that are deposited on two sides of a MCP 100. An incident electron 120 striking on a wall of a pore 106 near the input face of the MCP 100 will induce the emission of secondary electrons from the pore wall surface, which is coated with the electron emissive coating 114. The secondary electrons will be then accelerated further along the pore 106 by the bias potential, ultimately resulting in the secondary electrons' collisions with the pore wall. The collisions of the secondary electrons with the pore wall also produce secondary electrons, resulting in an electron avalanche inside the pore 106 and the emission of a cloud of electrons from the output of the pore 106. Since the entirety of the pores 106 of the MCP 100, which can number in the millions, each operate independently, the MCP 100 is image-preserving. The amplification gain depends on the applied bias voltage, the secondary emission of the pore surface, and the geometry of the pore 106.

The applied bias voltage is generated from a power source 122. The power source 122 applies a high voltage ("HV") across the electrodes 116. The selection of a particular HV is based at least in part on the desired and at least in part on the MCP geometry and electrical properties. The HV directly provides the electric field according to E=V/d (e.g., in an MCP with a 1.2 mm thickness and a HV of 1.2 kV, E will be 1 MV/m). As discussed above, in some arrangements the HV is in the range of 1.2 kilovolts. In such arrangements, the gain of the MCP 100 may be in the range of $10^3$-$10^5$. The generation of secondary electrons is also based on the incident electron energy, angle of incidence and the secondary electron yield ("SEY") of the emission surface (i.e., the surface coated with the emissive coating 114). The SEY ($\delta$) is defined as the ratio of secondary electrons emitted to primary electron incidents on the surface. For practical reasons, MCPs are typically manufactured with intrinsic resistances in the range of 1 MΩ-1 GΩ, allowing the bias current to recharge electron depleted pores (i.e., post-avalanche) without drawing too much current (i.e., to prevent over-heating, thermal runaway, and the need for large high voltage power supplies).

Referring to FIG. 2, a schematic cross-sectional view of a system on chip ("SoC") type digital electron amplifier 200 is shown according to an exemplary embodiment. The digital electron amplifier 200 is a digital electron amplifier having an anode readout ("DEAAR"). The digital electron amplifier 200 may be a micro-electro-mechanical system ("MEMS"). The digital electron amplifier 200 includes an electron amplification structure ("EAS") 202. In some arrangements, the EAS 202 is an MCP. The MCP may have the same or similar arrangement as described above with respect to MCP 100. The EAS 202 includes a top electrode 204 and a bottom electrode 206. A high voltage power supply (e.g., power source 122) is coupled to the top and bottom electrodes 204 to generate a high voltage potential (e.g., 1.2 kV) across the EAS 202. The EAS 202 includes a first insulating oxide layer 208 positioned on a bottom side of the bottom electrode 206. The EAS 202 includes a resistive layer 210 positioned between a top side of the bottom electrode 206 and a bottom side of the top electrode 208. The EAS 202 includes a plurality of pores 212. The pores 212 travel through the insulating oxide layer 208, the bottom electrode 206, the resistive layer 210, and the top electrode 204. Each of the pores 212 is lined with a secondary electron emission ("SEE") coating 214. The SEE may be a conformal SEE coating.

The EAS 202 is coupled to a second insulating oxide layer 216 having embedded anode lines 218 running through the second insulating oxide layer 216. In some arrangements, the anode lines 218 that form an anode structure are arranged in a serpentine manner. In alternative arrangements, the anode lines 218 are arranged in another shape or structure depending on the application. The anode lines 218 are metal. The anode structure is exposed at a bottom of each of the pores or groups of pores 212. The anode lines 218 are used to provide a current output that is indicative to an amount of electrons detected by the digital electron amplifier 200. The anode lines 218 include contacts 220 (X1, X2, Y1, and Y2) that allow the coupling of an electronic device to the digital electron amplifier 200. The second insulating oxide layer 216 is coupled to a base substrate 222. In some arrangements, the base substrate is a metallic substrate. The fabrication process for the digital electron amplifier 200 is described in further detail below with respect to method 300.

Figure 3:
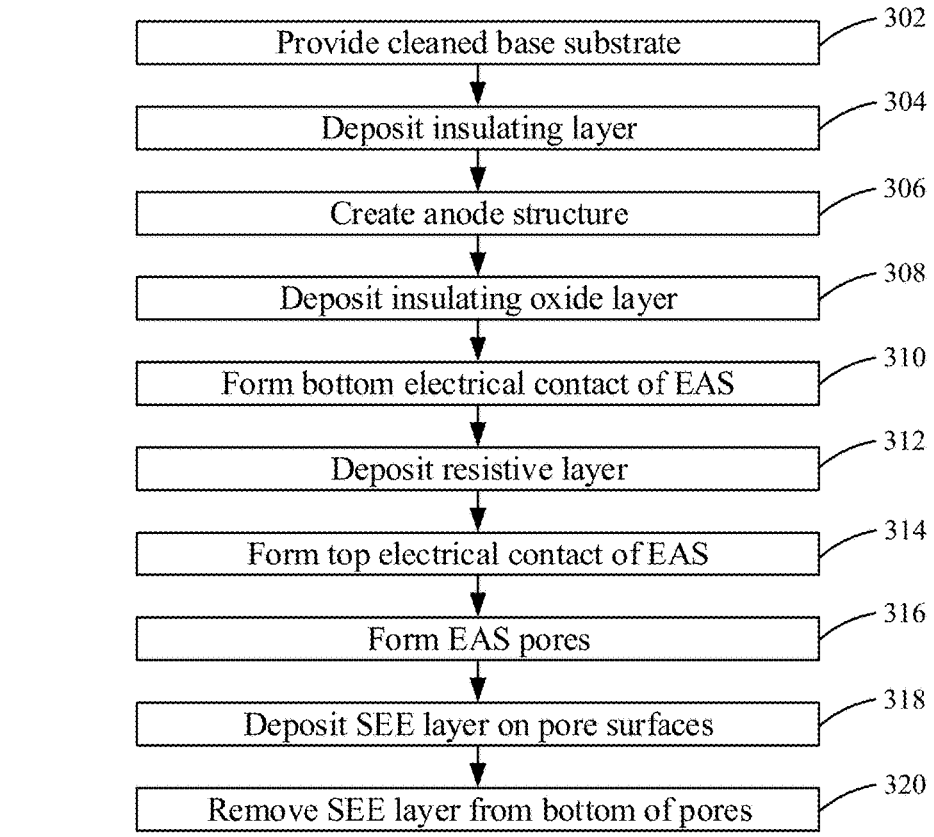
FIG. 3 is a flow diagram of a method of fabricating a digital electron amplifier SoC having a MCP electron amplification structure according to an exemplary embodiment.
Figure 4F:
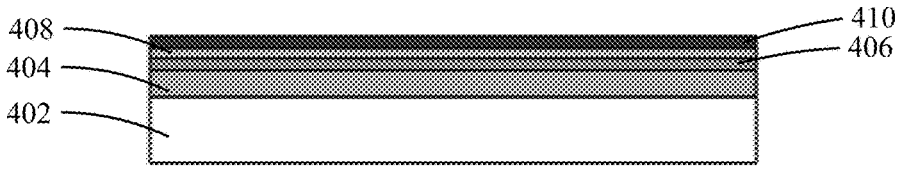
FIGS. 4A through 4N are various cross-sectional views of the digital electron amplifier SoC formed by the method of FIG. 3 during various phases of fabrication.
Figure 4G:
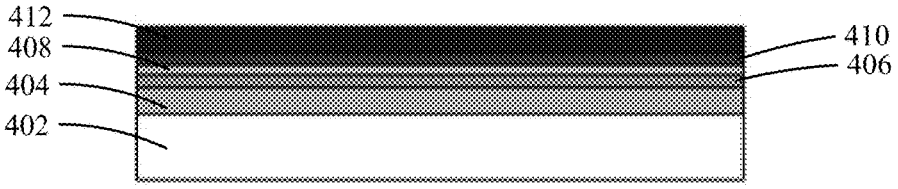
Figure 4H:
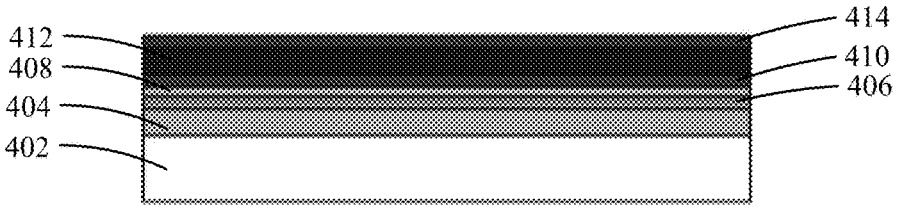
Figure 4I:
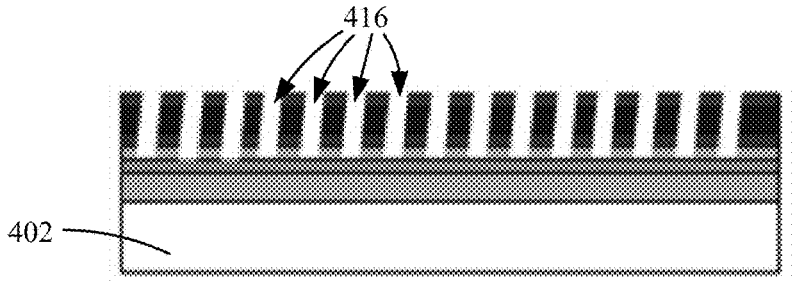
Figure 4J:
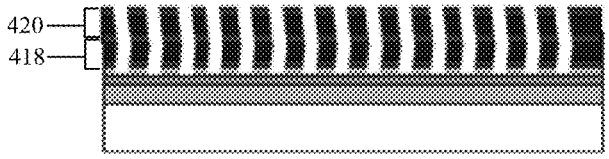
Figure 4K:
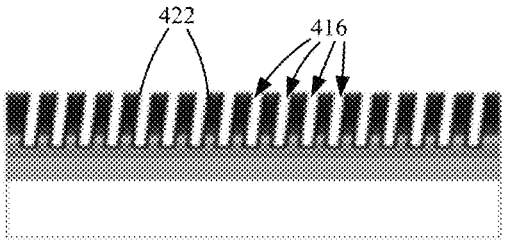
Figure 4L:
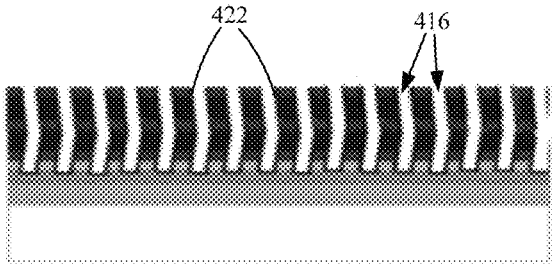
Figure 4M:
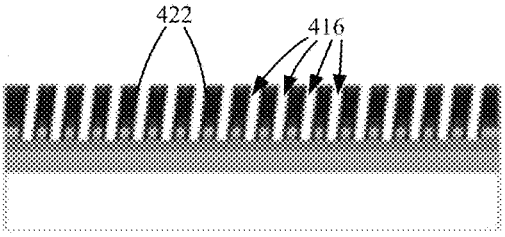
Figure 4N:
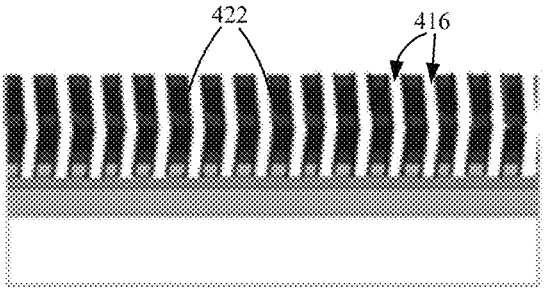

Referring to FIG. 3, a flow diagram of a method 300 of fabricating a digital electron amplifier SoC having a MCP EAS (e.g., digital electron amplifier 200) is described according to an exemplary embodiment. FIGS. 4A through 4N show cross-sectional views of the digital electron amplifier at various times during the method 300. The steps of method 300 may be performed by a technician utilizing specialized equipment or by an automated digital electron amplifier fabrication machine.

Method 300 begins with the provision of a cleaned base substrate at 302. As shown in FIG. 4A, the substrate 402 is a wafer having a planar top and a planar bottom. In some arrangements, the substrate 402 is a silicon wafer. The substrate 402 is clean (i.e., substantially dust, dirt, and oil free). The substrate 402 may be cleaned through a wet cleaning process (e.g., with a solvent, such as acetone or methanol, through a buffer oxide etch, through a standard semiconductor industry RCA cleaning procedure, with water, etc.) or through a dry cleaning process (e.g., with a wipe, via electrostatic cleaning, etc.) The substrate 402 may be any size substrate. In some arrangements, the substrate 402 is at least eight inches by eight inches. The substrate 402 may be cylindrical in shape. In some arrangements, the substrate 402 is a flexible substrate, such as a plastic, a glass, a ceramic, or the like. In such arrangements, the resulting digital electron amplifier SoC may be formed in a non-planar shape.

An insulating layer is deposited on the base substrate 402 at 304. The insulating layer isolates the EAS structure bottom electrode and the anode structure thereby preventing an electrical short between the two layers. As shown in FIG. 4B, the insulating layer 404 is positioned on a top surface of the base substrate 402. The insulating layer 404 is less than 500 nm in thickness. The insulating layer 404 may be silicon dioxide ($SiO_2$), aluminum oxide ($Al_2O_3$), titanium dioxide ($TiO_2$), or the like. The insulating layer may also be metal nitride such as silicon nitride ($Si_3N_4$), or any other dielectric material. The insulating layer 404 may be deposited through a thermal growing process or through a physical or chemical deposition process. For example, the base substrate 402 may be silicon and may be placed in a large batch furnace with an oxidizing environment until the appropriate thickness of a silicon dioxide layer forms on the surface of the substrate 402.

An anode structure is created on the insulating layer at 306. As shown in FIGS. 4C and 4D, the anode structure 406 is positioned on a top surface of the insulating layer 404. The insulating layer 404 electrically insulates the anode structure 406 from the base substrate 402. The anode structure 406 is formed from a highly conductive metal (e.g., platinum, nickel-chromium, tungsten, molybdenum, silver, gold, etc.) and has a thickness of approximately 100 nm. The anode structure 406 may be patterned via photo resistive application. The anode structure 406 is shaped using electron beam writing, photolithography, etching, or the use of a mask during the application to form the appropriate anode structure 406 shape. The anode structure 406 may be shaped into a comb pattern, a serpentine crossed-lines pattern (e.g., as shown in FIG. 4D), in parallel lines, in a grid pattern, in a grating structure pattern, in an array of dots of any shape and size, or in any other desired pattern. The shape of the anode structure 406 provides contact pads outside of the EAS active device area. After the anode structure 406 is shaped, the anode structure 406 is cleaned to remove any excess material removed during the shaping process.

An insulating oxide layer is deposited at 308. As shown in FIG. 4E, the insulating oxide layer 408 is deposited on top of the anode structure 406. The insulating oxide layer 408 is less than 500 nm in thickness. The insulating layer 404 may be silicon dioxide ($SiO_2$), aluminum oxide ($Al_2O_3$), titanium dioxide ($TiO_2$), or the like. In some arrangements, the insulating layer may be a metal nitride ($Si_3N_4$), such as silicon nitride, or another dielectric material. The insulating layer 404 may be deposited through a thermal growing process or through a physical or chemical deposition process as described above with respect to step 304. The insulating layer 408 creates a non-conductive gap between the anode structure 406 and the EAS.

A bottom electrical contact of the EAS is formed at 310. As described above with respect to FIG. 2, the contemplated EAS (e.g., EAS 202) includes a bottom electrical contact 410 (shown in FIG. 4F). The bottom electrical contact 410 is formed on top of the insulating layer 408. The bottom electrical contact 410 is a metal layer deposited on top of the insulating layer 408. The bottom electrical contact 410 has a thickness of approximately 100 nm. The metal used to form the bottom electrical contact 410 may be platinum, nickel-chromium, tungsten, molybdenum, silver, gold, or another conductive metal.

A resistive layer is deposited on top of the bottom electrical contact at 312. As shown in FIG. 4G, a resistive layer 412 is deposited on top of the bottom electrical contact 410. The resistive layer has a thickness between 100 nm to one micron (i.e., 1000 nm). The specific thickness of the resistive layer 412 is selected based on a desired aspect ratio or the pores. For example, if a desired EAS structure has a pore aspect ratio of 20 with a desired pore diameter of 500 nm, the resistive layer is selected to be 10 microns thick. As another example, if the resistive layer is 1 micron thick and the pores have a diameter of 50 nm, the pore aspect ratio is still 20. Accordingly, the thickness of the resistive layer depends on the desired aspect ratio. In some arrangements, the pore size is tunable through a lithography and etching process (wet or dry etching). The pores need not all have the same geometry or spacing. For example, it may be advantageous in some applications to have a high density of pores in one region of the detector and a lower density of pores in other regions. In such arrangements, the detector could mimic the foveal vision of the human eye, and in doing so, achieve an optimum balance of cost and performance. The ability to vary the thickness and composition of the resistive layer 412 allows for a tunable EAS. The resistive layer 412 may be deposited on top of the bottom electrical contact 410 in a similar manner as describe in US Patent Application Publication No. 2013/0280546, entitled "TUNABLE RESISTANCE COATINGS," and in U.S. Pat. No. 8,921,799, entitled "TUNABLE RESISTANCE COATINGS," both of which are hereby incorporated by reference in its entirety and for all purposes. In an alternate arrangement, the resistive layer 412 could be deposited by physical or chemical vapor deposition.

Still referring to FIG. 3, a top electrical contact of the EAS is formed at 314. As shown in FIG. 4H, a top electrical contact 414 is formed on top of the resistive layer 412. The top electrical contact 414 is similar to the bottom electrical contact 410. Accordingly, the top electrical contact 414 is a metal layer deposited on top of the insulating layer 408. The top electrical contact 414 has a thickness of approximately 100 nm. The metal used to form the top electrical contact 414 may be platinum, nickel-chromium, tungsten, molybdenum, silver, gold, or another conductive metal.

Any of the above described layers formed in steps 304 through 314 may be formed by chemical vapor deposition ("CVD"), atomic layer deposition ("ALD"), physical vapor deposition ("PVD"), chemical printing technology (including three-dimensional printing), solution growth type thin film deposition, and the like.

EAS pores are formed at 316. As shown in FIG. 4I, EAS pores 416 are formed in the EAS. The pores 416 are formed through the top electrical contact 414, the resistive layer 412, the bottom electrical contact 410, and the insulating oxide layer 408. The pores 416 expose the anode 406. The EAS pores 416 are formed through photolithography or other suitable methods. For example in one embodiment a photo resist application is applied to the top surface of the top electrical contact 414. Direct electron beam writing or mask application is used on the photo resistive application to provide the desired pore structure (e.g., the number of pores, the size of the pores, the arrangement of the pores with respect to each other, etc.). The digital electron amplifier SoC wafer is then placed on a bias angle with respect to an etching device ahead of etching. The bias angle causes the pores to be non-perpendicular with respect to the layers of the digital electron amplifier SoC wafer. The bias angle is typically between zero and eight degrees. After the wafer is placed at the bias angle, the wafer is etched from the top electrical contact 414 through the insulating oxide layer 408 according to the masked or electron beam designated pore pattern. The etched wafer is cleaned (e.g., to remove debris from the etching process). The pores 416 create a contact pad for the top and bottom electrical contacts 416 and 410. Various individual electrical contact pads may be created by adding the electrical contact pad structure on a lithography mask and performing selective layer etching on the electrical contact pad structure. Some digital electron amplifier SoC wafers have multiple EAS sections. For example, as shown in FIG. 4J, an example digital electron amplifier SoC wafer having two EAS sections 418 and 420 is shown. In such arrangements, the top electrode of the bottom EAS section 418 serves as the bottom electrode of the top EAS section 420. In some arrangements, such as the arrangement shown in FIG. 4J, only one insulating oxide layer is positioned below the bottom EAS section 418. In other arrangements, step 308 is repeated to create a second insulating oxide layer on top of the bottom EAS section 418 prior to depositing the layers of the second EAS section 420. The second EAS section 420 is created by repeating steps 312 and 314 of method 300. When the pores are formed through the second EAS section 420 in repeating step 316, the wafer is turned 180 degrees with respect to the bias angle of step 316 to form the pores in the second EAS section 420 at a different bias angle than the pores of the first EAS section 418. The pores formed through the second EAS section 420 line up with and connect to the pores formed through the first EAS section 418 such that a continuous path can be taken through the first and second EAS sections 418 and 420 through each of the pores. The steps of forming the second EAS layer 420 can be repeated to form any number of EAS sections on a single digital electron amplifier SoC wafer. In this way, multiple stages of electron amplification can be achieved while minimizing the possibility for feedback—a phenomenon in which positive ions formed during operation are accelerated towards the front of the MCP device causing additional, spurious signals in a given pore. The multiple amplification stages can be arranged in a chevron or z-stack configuration as are typically employed in conventional MCP based detectors.

Generally, the stacking of multiple two-dimensional EAS structures will provide multiple two dimensional dynodes in series. The thickness and pores size and secondary electron emission coefficient of subsequent EAS structure will define the next electrons amplification. In such arrangements, it is possible to precisely control individual dynodes structure properties and first strike. Further, a two-dimensional EAS dynode in series stack will also permit the energetic particle trajectory mapping in a very unique manner. For example, in a multiple EAS structure arrangement, the top most EAS structure may have a single emission (i.e., bounce) of electrons because of the selected aspect ratio. The subsequent underneath EAS structure may permit single or multiple bounces of electrons. As another example, in a multiple stack arrangement of EAS structures, each EAS structure may have only one precisely controlled electron emissions (i.e., bounce). In this example, this type of structure is similar to dynode structures where electrons bounce at various stages are controlled by individual dynode structures.

An SEE layer is deposited on the surfaces of the pores at 318. As shown in FIG. 4K (single EAS section) and in FIG. 4L (two EAS sections), an SEE layer 422 is deposited along the pores 416. The SEE layer 422 is approximately 2-20 nm in thickness. The SEE layer 422 may be aluminum oxide ($Al_2O_3$), silicon dioxide ($SiO_2$), calcium fluoride ($CaF_2$), magnesium oxide (MgO), or another material. In some arrangements, the SEE layer 422 is formed through ALD, which provides a uniform deposition on the walls of the pores 416. In some arrangements, the SEE layer 422 is enriched with neutron sensitive material. The neutron sensitive material may be boron, lithium, gadolinium, hafnium, cadmium, or the like.

The SEE layer is removed from a bottom portion of the pores at 320. As shown in FIG. 4M (single EAS section) and FIG. 4N (two EAS sections), the SEE layer 422 is removed from the bottom of the pores 416, which exposes the anode structure 406. The SEE layer 422 may be removed from the bottom of the pores 416 through a mild directional dry etching process. The digital electron amplifier SoC wafer may be cleaned after the etching process to remove any debris formed during etching.

Figure 5:
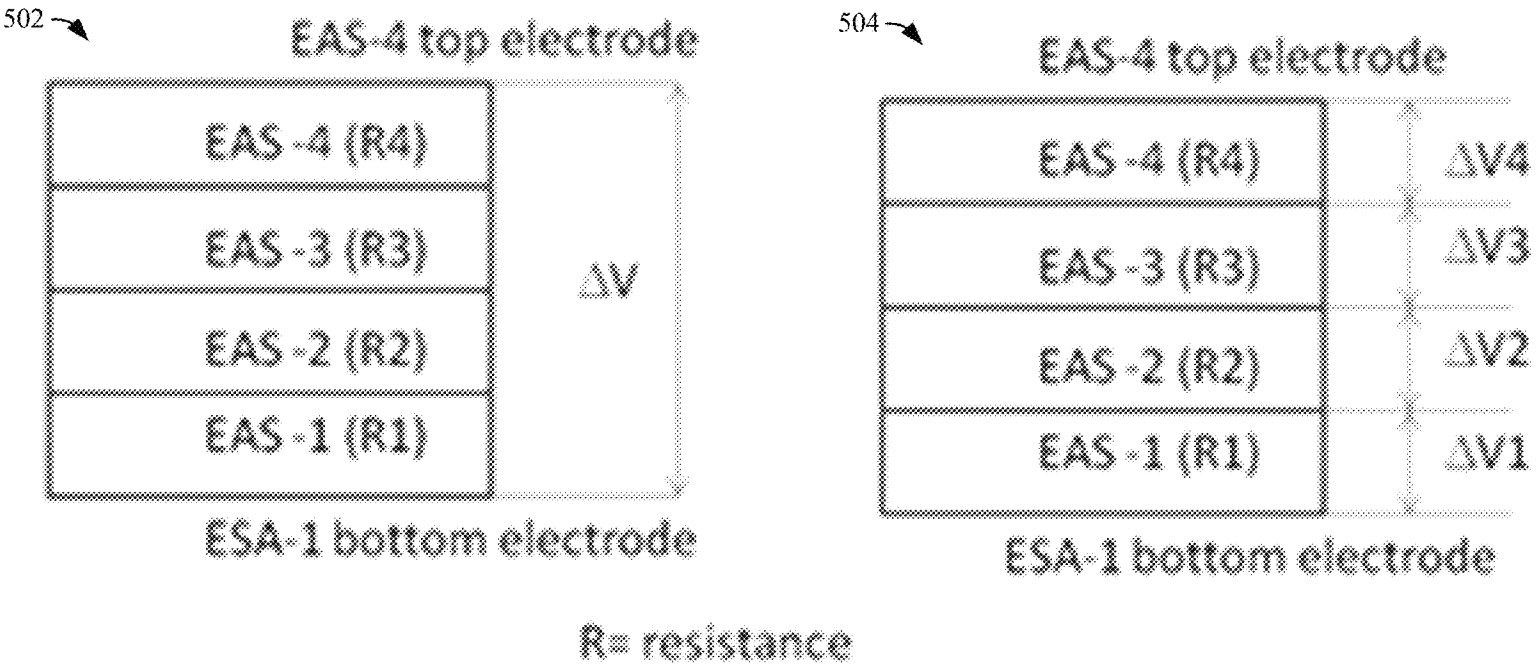
FIG. 5 shows two schematic diagrams of two different multiple EAS section digital electron amplifier SoC wafers according to exemplary embodiments.

In arrangements where there digital electron amplifier SoC wafer has multiple EAS sections, each EAS section can have a different resistive coating material composition, which permits independent control over each EAS structure and the amplification rate. Whereas, if the same resistive coating is applied to each of the multiple EAS sections, then it is possible to simply use only two contact pads for electrical connections. FIG. 5 shows two schematic diagrams of two different multiple EAS section digital electron amplifier SoC wafers 502 and 504. Each of the wafers 502 and 504 includes a plurality of EAS sections—EAS-1, EAS-2, EAS-3, and EAS-4. Each of the EAS sections has a resistive coating (R1 through R4). In wafer 502, the resistive coatings are comprised of the same materials. Accordingly, a single voltage ($\Delta V$) can be applied between EAS-4 and EAS-1, and the EAS structure will divide the voltage across each EAS section. Thus, the required number of electrical contacts are minimized (one at the bottom of EAS-1 and one at the top of EAS-4) to two electrical contacts. In wafer 504, the resistive coatings are comprised of different materials (i.e., $R1 \neq R2 \neq R3 \neq R4$). Accordingly, electrical contacts are required between each EAS section to provide different voltages ($\Delta V1$ through $\Delta V4$) to each EAS section.

The digital electron amplifiers having the structure described above with respect to FIGS. 1 and 2 and fabricated via method 300 provide for large, scalable digital electron amplification devices at a reduced cost compared to existing devices. The reduced cost derives from the massively parallel and automated fabrication methods developed for semiconductor manufacturing, as compared to the extremely labor intensive, piece-by-piece construction required in conventional MCP and photodetector fabrication. Accordingly, the digital electron amplifiers described in FIGS. 1 and 2 and formed via method 300, may be utilized in many different types of equipment. For example, the digital electron amplifier may be used with a cross-strip delay line read out structure for various imaging and position tracking applications. In arrangements where the SEE layer 422 is enriched with a neutron sensitive material, the digital electron amplifier may be used in devices that detect nuclear radiation from radioactive materials, such as uranium and plutonium. The digital electron amplifiers may be used in other devices, such as biomedical devices, positron emission tomography scanners, low-level signal detection, photodetection, high energy physics scanners, astronomy scanners (e.g., telescopes), gas electron multipliers, ToF devices, molecular and atomic collision devices, electron microscopes, field emission displays, night vision applications, and the like. In some arrangements, the digital electron amplifiers are integrated into consumer electronics and portable devices, such as cell phones, tablets, portable media players, laptops, and the like, in high speed and high resolution camera applications. Furthermore, the substrate 402 can be a semiconducting material such as a silicon wafer that has previously been processed to create integrated circuitry such as complementary metal oxide semiconductor (CMOS) logic and memory. In this way, the MCP-based photodetector can be integrated with digital processing and/or data storage capabilities.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "connected" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "above," "below," etc.) are merely used to describe the orientation of various elements in the figures. It should be noted that the orientation of various elements may differ according to other exemplary embodiments, and that such variations are intended to be encompassed by the present disclosure.

The construction and arrangement of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and/or assemblies of the enclosure may be constructed from any of a wide variety of materials that provide sufficient strength or durability, and in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present inventions. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other exemplary embodiments without departing from scope of the present disclosure or from the spirit of the appended claims.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure as defined in the appended claims. Such variations will depend on the software and hardware systems chosen and on designer choice. It is understood that all such variations are within the scope of the disclosure. Likewise, software and web implementations of the present disclosure could be accomplished with standard programming techniques with rule based logic and other logic to accomplish the various database searching steps, correlation steps, comparison steps and decision steps.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. A method of fabricating a digital electron amplifier system on chip, the method comprising:

providing a base substrate having a top surface;

depositing an insulating layer on the top surface of the base substrate;

providing an anode structure on top of the insulating layer;

depositing an insulating oxide layer on top of the anode structure;

forming an electron amplification structure ("EAS") on top of the insulating oxide layer, the EAS having a bottom electrical contact, a top electrical contact, and a resistive layer positioned in between the bottom electrical contact and the top electrical contact; and forming electron amplification pores, each of the electron amplification pores passing through the top electrical contact, the resistive layer, the bottom electrical contact, and the insulating oxide layer thereby exposing the anode structure at a bottom of each of the electron amplification pores and each of the electron amplification pores defined by an electron amplification pore wall; and depositing a secondary electron emission ("SEE") layer on the each of the electron amplification pore walls, the SEE layer selected from a material configured to emit secondary electrons when a primary electron impacts the SEE layer while a bias voltage is applied across the SEE layer.

2. The method of claim 1, wherein forming the electron amplification pores includes orienting the digital electron amplifier system on chip at a non-perpendicular bias angle with respect to an etching device that forms the pores to cause the electron amplification pores to be oriented with the bias angle such that the electron amplification pores are not perpendicular with respect to the top surface of the base substrate.

3. The method of claim 1, wherein the SEE is a uniform layer on the electron amplification pores walls.

4. The method of claim 3, wherein depositing the SEE layer covers a bottom of each of the electron amplification pores thereby covering the anode structure with the SEE layer, and wherein the method further comprises removing a portion of the SEE layer that covers the anode structure from each of the electron amplification pores.

5. The method of claim 1, further comprising cleaning the base substrate through a wet cleaning process or a dry cleaning process.

6. The method of claim 1, wherein the base substrate is a flexible substrate.

7. The method of claim 1, wherein the anode structure is shaped into a serpentine pattern using electron beam writing, photolithography, or an etching process.

8. The method of claim 1, wherein:

the EAS is a first EAS;

the electron amplification pores are first electron amplification pores; and the method further comprises:

forming a second EAS structure on top of the first EAS structure, the second EAS structure having a second resistive layer and a second top electrical contact, the second resistive layer positioned between the top electrical contact of the first EAS and the second top electrical contact of the second EAS; and forming second electron amplification pores, each of the second electron amplification pores passing through the second top electrical contact and the second resistive layer, the second amplification pores line up with and connect to the first electron amplification pores of the first EAS.

9. The method of claim 8 wherein the second electron amplification pores have a different bias angle than the first electron amplification pores with respect to the base substrate.

10. The method of claim 1, wherein the digital electron amplifier system on chip is at least eight inches by eight inches in size.

11. A method of fabricating a secondary electron emission layer within electron amplification pores, the method comprising:

forming an electron amplification structure ("EAS") on top of an insulating oxide layer of an anode structure, the EAS having a bottom electrical contact, a top electrical contact, and a resistive layer positioned in between the bottom electrical contact and the top electrical contact; and forming electron amplification pores, each of the electron amplification pores passing through the top electrical contact, the resistive layer, the bottom electrical contact, and the insulating oxide layer thereby exposing the anode structure at a bottom of each of the electron amplification pores and each of the electron amplification pores defined by an electron amplification pore wall;

depositing a secondary electron emission ("SEE") layer uniformly on the each of the electron amplification pore walls, the SEE layer selected from a material configured to emit secondary electrons when a primary electron impacts the SEE layer while a bias voltage is applied across the SEE layer.

12. The method of claim 11, wherein depositing the SEE layer covers a bottom of each of the electron amplification pores thereby covering the anode structure with the SEE layer, and wherein the method further comprises removing a portion of the SEE layer that covers the anode structure from each of the electron amplification pores.

13. The method of claim 11, wherein:

the EAS is a first EAS;

the electron amplification pores are first electron amplification pores; and the method further comprises:

forming a second EAS structure on top of the first EAS structure, the second EAS structure having a second resistive layer and a second top electrical contact, the second resistive layer positioned between the top electrical contact of the first EAS and the second top electrical contact of the second EAS; and forming second electron amplification pores, each of the second electron amplification pores passing through the second top electrical contact and the second resistive layer, the second amplification pores line up with and connect to the first electron amplification pores of the first EAS.

14. The method of claim 13, wherein the second electron amplification pores have a different bias angle than the first electron amplification pores.

* * * * *